US005788348A

United States Patent [19]

Ramachandran et al.

[11] Patent Number: 5,788,348

[45] Date of Patent: Aug. 4, 1998

[54] AUTOMATED TELLER MACHINE WITH ENHANCED SERVICE ACCESS

[75] Inventors: Natarajan Ramachandran, Uniontown; Kim Raymond Lewis, Stow; Gerald T. Sedlock, North Canton; Charles D. Price, III, Salem; Richard Calvin Lute, Jr., Mogadore, all of Ohio

[73] Assignee: InterBold, North Canton, Ohio

[21] Appl. No.: 600,602

[22] Filed: Feb. 12, 1996

Related U.S. Application Data

[60] Continuation-in-part of Ser. No. 529,960, Sep. 19, 1995, which is a division of Ser. No. 213,404, Mar. 15, 1994, Pat. No. 5,483,047.

[51] Int. Cl.[6] ..... A47B 81/00

[52] U.S. Cl. ..... 312/223.1; 312/223.3; 312/311; 312/265.6; 312/283; 312/319.2; 292/216

[58] Field of Search ..... 312/223.1, 223.3, 312/223.6, 311, 263, 265.5, 265.6, 283, 324, 319.2; 235/379; 902/18, 19, 30, 31, 32, 33, 34, 35; 292/216; 221/6, 7, 8

[56] References Cited

U.S. PATENT DOCUMENTS

| | | | |
|---|---|---|---|
| 3,228,553 | 1/1966 | Breitenstein et al. | 221/6 |
| 4,154,437 | 5/1979 | Butcheck et al. . | |
| 4,370,006 | 1/1983 | Graef et al. . | |
| 4,595,828 | 6/1986 | Lundblad . | |
| 4,754,126 | 6/1988 | Caldwell | 235/379 |
| 4,775,783 | 10/1988 | Sasaki et al. | 235/379 |
| 4,917,420 | 4/1990 | Rogers, Jr. | 292/216 X |
| 5,017,026 | 5/1991 | Takesako et al. | 235/379 X |
| 5,112,119 | 5/1992 | Cooke et al. | 312/283 |
| 5,127,686 | 7/1992 | Gleason et al. | 292/216 |
| 5,568,362 | 10/1996 | Hansson | 312/223.6 X |
| 5,570,915 | 11/1996 | Asadurian | 292/216 X |

FOREIGN PATENT DOCUMENTS

| | | | |
|---|---|---|---|
| 0148599 | 11/1979 | Japan | 221/7 |
| 405143822 | 6/1993 | Japan | 221/6 |
| 2225891 | 6/1990 | United Kingdom | 235/379 |

*Primary Examiner*—Peter M. Cuomo
*Assistant Examiner*—Hanh V. Tran
*Attorney, Agent, or Firm*—Ralph E. Jocke

[57] ABSTRACT

An automated banking machine (10) includes an enclosure (12). The enclosure has an interior area (14) in which serviceable components (48, 52, 64, 68) are positioned on rollout trays (46, 50, 62, 66). The enclosure has a rear opening (18) which is selectively accessible through service doors (54, 58, 60). The enclosure further includes a front opening (16) which is bounded by a frame (20). A fascia (22) having input devices thereon is removably positionable in said frame. The fascia is held in engagement with said frame by a disengageable latch including locks (94, 98) and latching brackets (92). The locks are connected to release arms (102, 110) which enable releasing the disengageable latch once access to the interior area has been gained by opening the service doors. Serviceable components may be readily serviced by extending the components out of the interior area of the machine on the rollout trays. Adjacent rollout trays may be selectively extended and retracted to enable a service technician to service the components while occupying a minimum of floor space.

49 Claims, 13 Drawing Sheets

AUTOMATED TELLER MACHINE WITH ENHANCED SERVICE ACCESS

CROSS-REFERENCE TO RELATED APPLICATIONS

This Application is a Continuation-In-Part Application of Application Ser. No. 08/529,960 filed Sep. 19, 1995 which is a Divisional Application of Ser. No. 08/213,404 filed Mar. 15, 1994, now U.S. Pat. No. 5,483,047.

TECHNICAL FIELD

This invention relates to automated banking machines. Specifically, this invention relates to an automated teller machine enclosure which provides enhanced service access.

BACKGROUND ART

Automated teller machines (ATMs) are known in the prior art. Customers of financial institutions may perform banking transactions, make inquiries concerning the status of their accounts, pay bills and obtain other banking services using automated teller machines. Typically a customer uses a magnetically coded card that is inserted into the machine. The customer also inputs a personal identification number that allows the automated teller machine to verify the customer's identity. After the customer has conducted their transactions, the customer's card is returned along with one or more receipts which document the transactions conducted.

In recent years the number of transactions that may be conducted at automated teller machines has increased. Some automated teller machines now have the ability of reading and verifying checks or other instruments. This can be done by including a device in the automated teller machine such as is shown in U.S. Pat. No. 5,422,467 which is owned by the assignee of the present invention.

Some automated teller machines also now have the capability of recording information in a customer's passbook. This is important to individuals who want to keep track of the growth of their savings while maintaining a hard copy record of the status of their account. To accomplish this, automated teller machines may include a passbook printer and transport of the type shown in U.S. Pat. No. 5,507,481 which is owned by the assignee of the present invention.

Automated teller machines also have the capability of providing complete customer statements which provide a record of all the transactions related to their account. Such statements may be provided within an automated teller machine using a statement printer mechanism of the type shown in U.S. Ser. No. 08/213,411 filed Mar. 15, 1994 and a statement presenter mechanism as shown in U.S. Pat. 5,435,542, both of which are owned by the assignee of the present invention.

As more types of devices are housed within an enclosure of an automated teller machine, the problems of providing adequate service access becomes more complex. Although the devices for performing the various functions may be highly reliable, most require periodic servicing. Such servicing may include very infrequent repair or adjustment. In some cases the service required may include relatively frequent replacement of supplies such as paper or print ribbons. The more devices which are included within an enclosure of the ATM, the more difficult it becomes to provide service access for all the components.

The Applicants of the present invention have made strides towards improving service access to components which comprise an ATM through the development of the apparatus shown in their U.S. Pat. No. 5,483,047. This patent shows a universal ATM enclosure. This enclosure includes serviceable components on rollout trays. The components on the rollout trays may be moved outwardly through an open service door to provide ready access for servicing. The rollout trays housing the components are also arranged in a side-by-side relation so that the amount of floor space required for servicing the components is minimized. The disclosure of U.S. Pat. No. 5,483,047 is incorporated herein by reference.

While Applicants prior invention constitutes a significant improvement over the prior art, there still exists a need for providing even greater service access to the components comprising an automated teller machine. This is particularly true as more devices are added to the interior of the machine. Further, as more functions are available to be performed by an automated teller machine, the more customer display and input devices must be provided at the ATM fascia which forms the customer interface. Servicing components on a fascia can be difficult in many ATM configurations due to restricted service access.

Thus, there exists a need for an automated teller machine with improved service access for internal components and components which reside on a fascia which is part of the customer interface.

DISCLOSURE OF INVENTION

It is an object of the present invention to provide an automated banking machine that is more readily serviceable.

It is a further object of the present invention to provide an automated banking machine that requires less floor space for servicing.

It is a further object of the present invention to provide an automated banking machine which provides enhanced service access to components housed within the machine as well as components of a customer interface.

It is a further object of the present invention to provide an automated banking machine that enables access to internal components both from a front side and a rear side of an enclosure.

It is a further object of the present invention to provide an automated teller machine enclosure that enables service access through both a front opening and a rear opening of the machine.

It is a further object of the present invention to provide an automated teller machine enclosure suitable for housing a large number of components.

It is a further object of the present invention to provide an automated teller machine enclosure which has a modular construction suitable for producing machines of various sizes.

It is a further object of the present invention to provide an automated teller machine enclosure which includes rear service opening which may be accessed by opening a service door as well as a front service opening which may be accessed by removal of an ATM fascia.

Further objects of the present invention will be made apparent in the following Best Modes for Carrying Out Invention and the appended claims.

The foregoing objects are accomplished in a preferred embodiment of the present invention by an automated banking machine having a generally rectangular enclosure which houses a plurality of banking machine components in an interior area. The enclosure includes a front opening and a rear opening. The serviceable components of the machine are accessible through at least one of the front or rear openings.

The machine includes a service door which is movably mounted on the enclosure. The service door is controlled by a lock and is operable to selectively close the rear opening when the machine is in operation. The service door is opened when it is desired to gain access to the components which are accessible through the rear opening.

The machine also includes a fascia which is a part of the customer interface. The fascia is removably positioned in the front opening of the enclosure. When it is desired to service components which are accessible through the front opening or to service components that are mounted on the fascia, the fascia may be removed to open the front opening.

In the preferred embodiment of the invention the front fascia is secured in the front opening by a disengageable latch. When the fascia is in the front opening the disengageable latch is accessible only from the interior area of the machine. This ensures that authorized personnel have gained access to the interior area of the machine by unlocking and opening the service door before the fascia may be removed.

The components of the machine of the present invention are supported on rollout trays. The rollout trays are configured so that the components thereon may be moved out of the enclosure through the front opening when the fascia is removed or the rear opening when the service door is opened. The rollout trays are preferably arranged in a side-by-side relation so that a service technician may work on components extended on one rollout tray while standing in an area that would be occupied by an adjacent rollout tray when that tray is extended from the machine. This arrangement enables a service technician to perform the servicing functions by sequentially extending and retracting the trays without ever having to leave the service footprint of the extended trays.

BEST MODES FOR CARRYING OUT INVENTION

Figure 1:
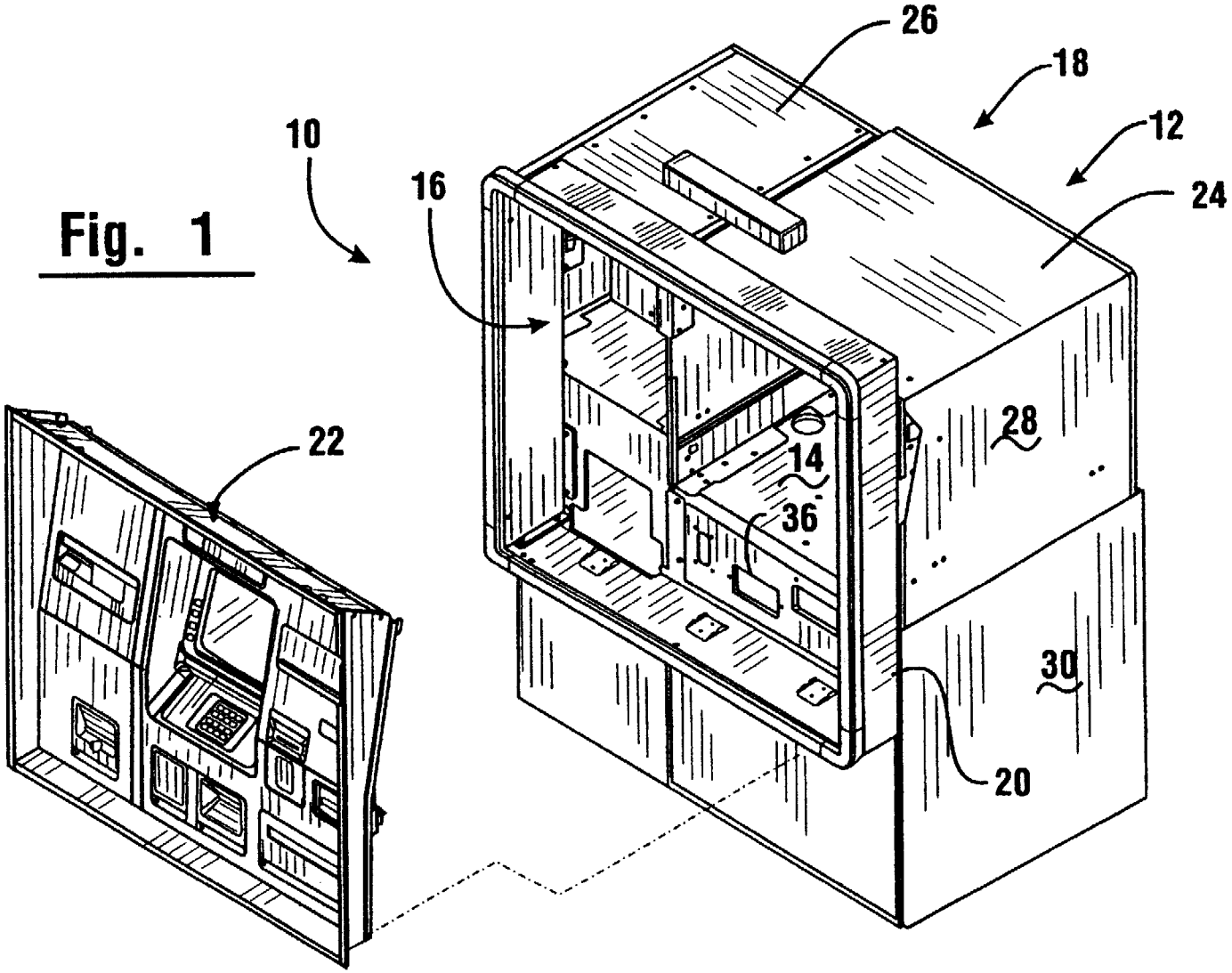
FIG. 1 is a front isometric exploded view of an automated banking machine enclosure of the present invention with the fascia of the enclosure in a removed condition.

Referring now to the drawings and particularly to FIG. 1, there is shown therein a preferred embodiment of the automated banking machine of the present invention generally indicated 10. Automated banking machine 10 comprises an enclosure generally indicated 12. Enclosure 12 bounds an interior area 14 of the automated banking machine which houses components of the machine. Enclosure 12 has a front opening generally indicated 16 and a rear opening generally indicated 18.

Enclosure 12 includes a generally rectangular frame 20. Frame 20 bounds the front opening. A fascia 22 which serves as a customer interface for the automated banking machine, is removably positioned in frame 20 so as to close front opening 16.

In the form of the invention shown in FIG. 1, enclosure 12 is comprised of a modular construction including a first enclosure portion 24 and a second enclosure portion 26. First enclosure portion 24 is comprised of a generally rectangular upper housing 28. Upper housing 28 is mounted above a secure chest 30, which in the preferred form of the invention is of a safe-like construction. Secure chest 30 is closed by a safe door 32, the opening of which is controlled by a combination or other high security lock generally indicated 34 (see FIG. 2). Secure chest 30 is used for holding items of value which may be stored within the ATM. This includes currency or deposits which may be made into the machine by customers. Secure chest 30 includes openings 36 which enable the passage of such items of value to and from the interior of the secure chest.

Figure 4:
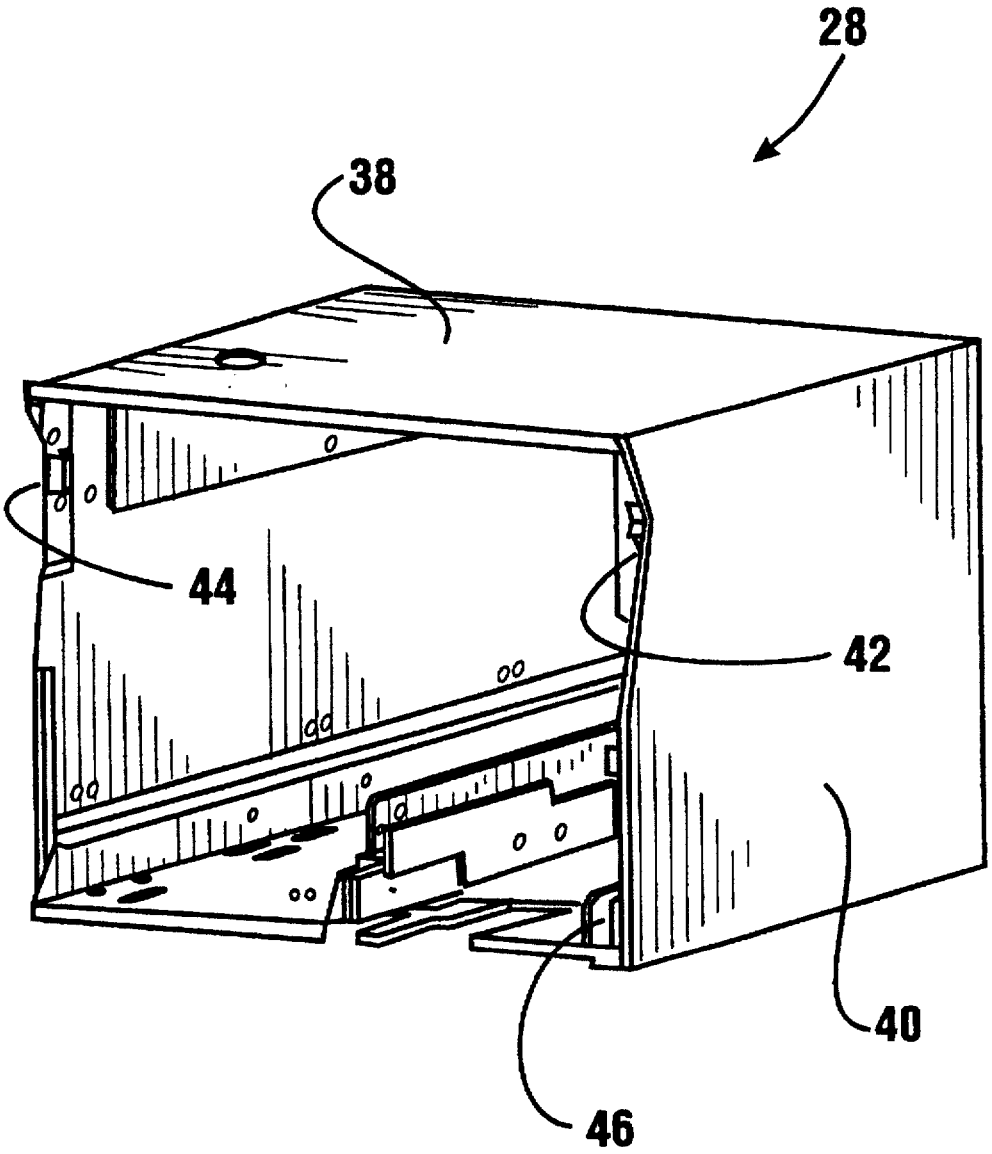
FIG. 4 is a front isometric view of a universal enclosure component of the automated banking machine shown in FIG. 1.

Upper housing 28 is shown in greater detail in FIG. 4. Upper housing 28 includes a top wall 38 and a pair of spaced side walls 40. Upper housing 28 is of the type disclosed in U.S. Pat. No. 5,483,047 the disclosure of which is incorporated herein by reference.

Upper housing 28 further includes a pair of mounting areas 42 and 44. Mounting areas 42 and 44 are adapted for connecting to a fixed type rectangular bracket so as to hold frame components thereto in a manner hereafter discussed. Mounting areas 42 are also of the type that are adapted to accept a rotational bracket thereto which is used in other types of ATM fascias.

Figure 2:
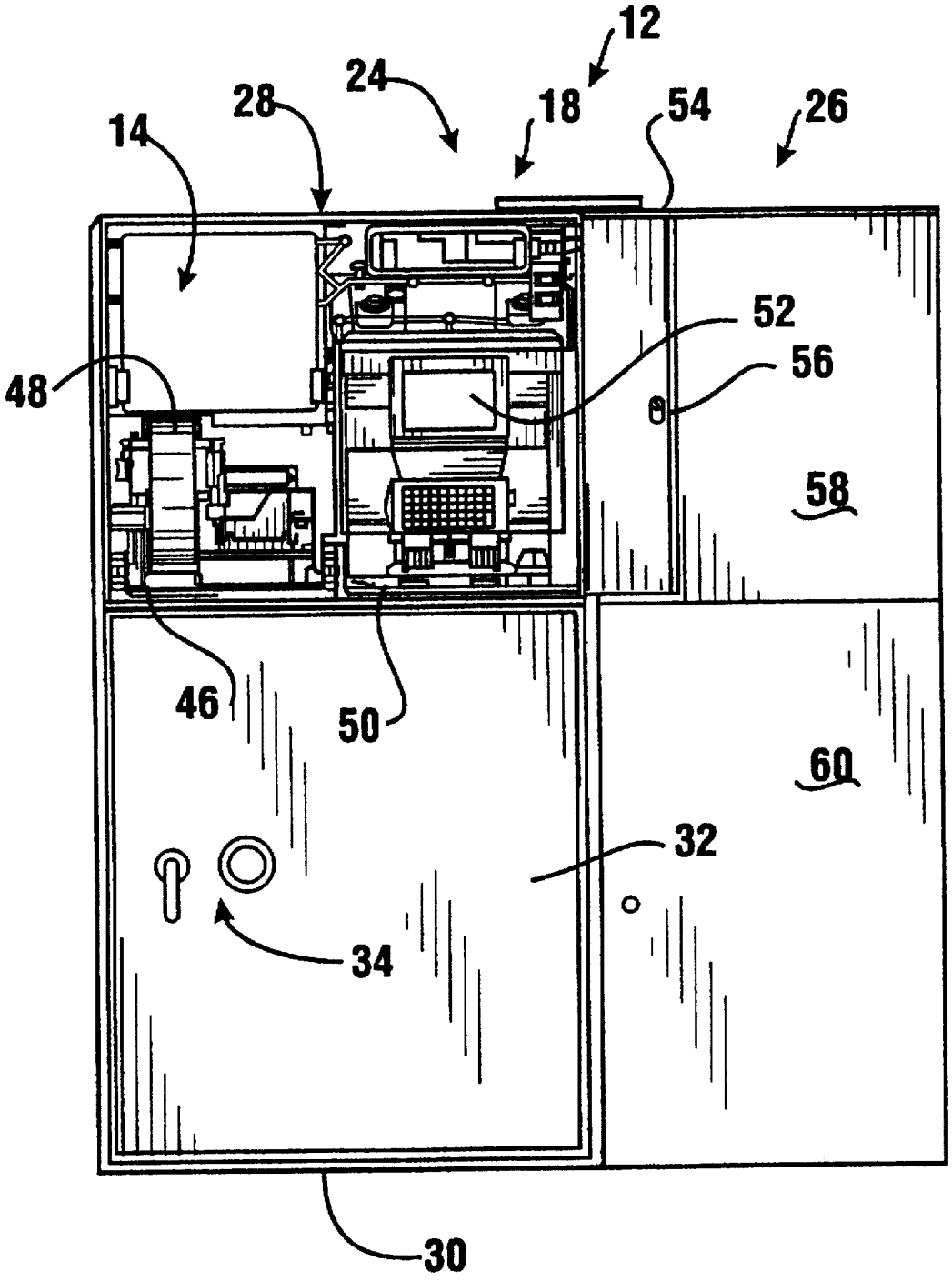
FIG. 2 is a rear plan view of the automated banking machine shown in FIG. 1 with a rear access door in an open condition.

Upper housing 28 has a rollout tray 46 therein. As shown in FIG. 2, components of the automated banking machine are supportably mounted on rollout tray 46. In FIG. 2 a customer receipt printer and journal printer assembly generally indicated 48 is supportedly mounted on rollout tray 46. This component is only exemplary and in embodiments of the invention other types of components which perform other functions may be positioned on tray 46. This construction enables rollout tray 46 to be moved so as to extend outwardly through the rear opening 18 of the machine. This makes the component of the machine mounted on tray 46 much more accessible for servicing.

As shown in FIG. 2, upper housing 28 includes a further rollout tray 50 which is positioned in side-by-side relation with rollout tray 46. Rollout tray 50 supports a CRT generally indicated 52 and other components thereon. Rollout tray 50 enables the CRT and other components supported thereon to be moved out the rear opening 18 of the machine supported on the rollout tray for servicing.

It should be understood that while rollout trays 46 and 50 have been discussed with regard to moving out the rear opening 18 of the machine, in other embodiments they may be configured so as to be movable out the front opening 16 of the machine. Alternatively, in other embodiments one such rollout tray may be arranged to be movable out the front opening and the other movable out the rear opening. Further, in other embodiments each of the rollout trays may be movable either out the front opening or the rear opening by a service technician. The determination as to whether the rollout trays are movable out the front or the rear openings will depend on the arrangement of components inside the automated banking machine as well as the space constraints in the area where the machine is located. For example, in other embodiments of the invention space constraints may dictate that all servicing be done from the front in which case the rollout trays would be arranged to extend from the front of the machine and the safe door of the secure chest 30 would be relocated so as to be either in the front or on a side of the machine.

A fundamental advantage of the service configuration shown in FIG. 2 is that the amount of floor space required for servicing the machine is minimized. This is achieved by enabling the technician to extend one of the rollout trays to service components thereon while leaving the other rollout tray within the interior area of the machine. This enables the service technician to stand in the floor space that would be occupied by the components on the other rollout tray when extended. When the service technician has completed work on the components on the extended tray, he or she could then return those components by moving them back into the interior area by retracting the rollout tray, move to the floor space previously occupied by the extended tray and extend the adjacent rollout tray to service the components thereon.

It should be understood that while two component holding trays are shown in side-by-side relation in FIG. 2, additional component holding trays may be used as later discussed. Further, all of the component holding trays are configured so as to be moved to extend out of the enclosure 12 to facilitate servicing of components thereon. Thereafter the components may be returned to the interior area of the machine by retracting the rollout trays. The rollout trays used in the preferred embodiment of the invention have appropriate latching mechanisms for latching them in the proper operating position when they are retracted from the service position into the machine.

Upper housing 18 has a service door 54 attached thereto in hinged relation. Service door 54 is selectively movable between an open position shown in FIG. 2 wherein access to the components of the machine is provided through rear opening 18. Service door 54 is also selectively movable to a closed position shown in FIG. 3 wherein the rear opening of upper housing 28 is closed. Service door 54 has a lock 56 in connection therewith. In the preferred form of the invention lock 56 is a key-type lock which limits access to the interior area 14 of the machine to only authorized personnel. Second enclosure portion 26 includes an upper service door 58 and a lower service door 60. Upper and lower service doors 58 and 60 are each controlled by key locks or other conventional type locks.

Figure 3:
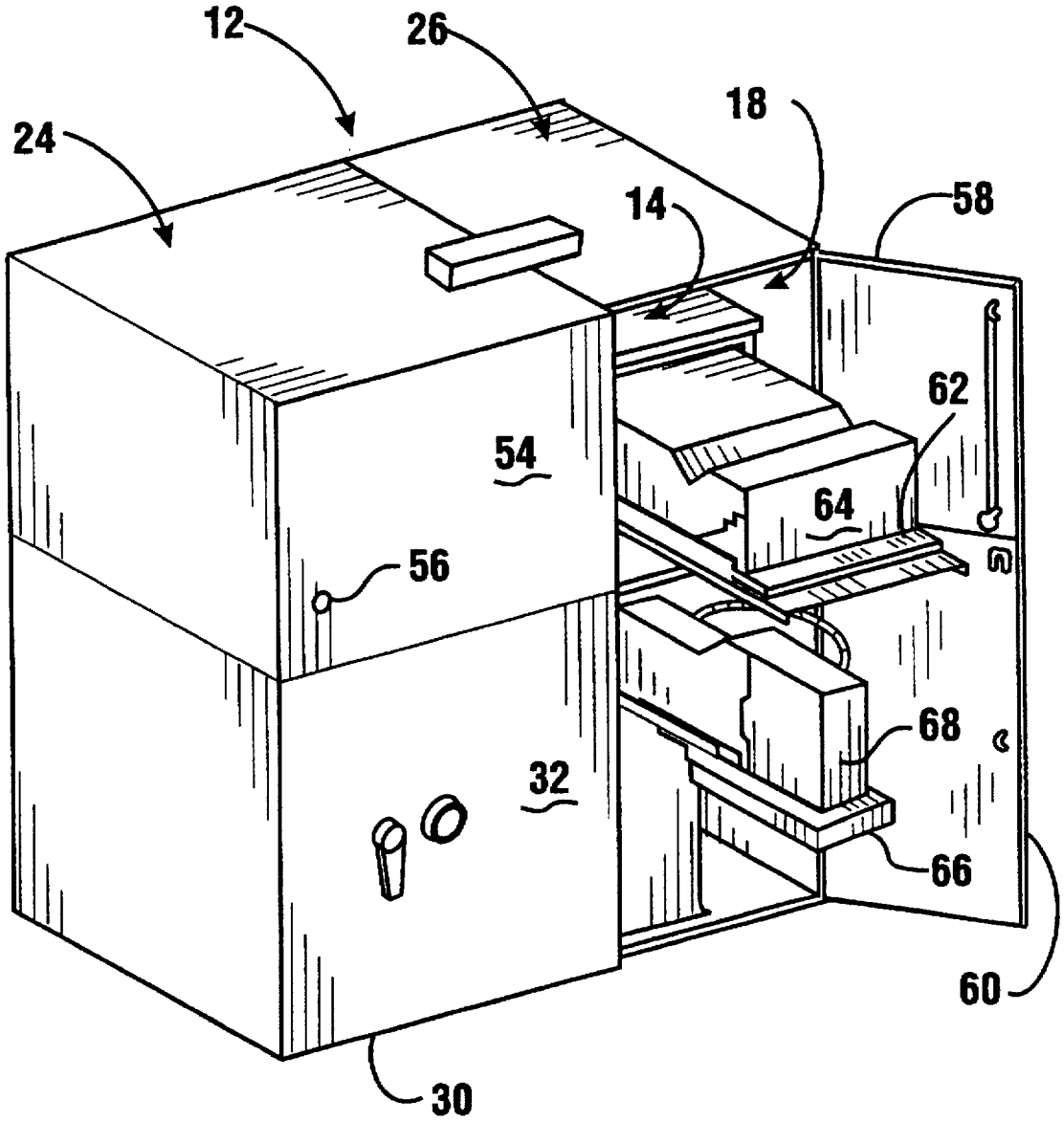
FIG. 3 is a rear isometric view of the automated banking machine shown in FIG. 2 with other rear access doors shown in an open condition and components of the machine extended therethrough on rollout trays.

As shown in FIG. 3, upper service door 58 is mounted in hinged relation on second enclosure portion 26 and is selectively movable to an open condition. In the open condition of service door 58, a rollout tray 62 is movable out of the rear opening 18 of second enclosure portion 26. Rollout tray 62 has components of the automated banking machine supported thereon. In the preferred form of the invention the components supported on tray 62 are a passbook transport and printer mechanism generally indicated 64.

Lower service door 60 is also movable to an open condition as shown in FIG. 3. In this condition a further rollout tray 66 is movable to extend from the enclosure 12 to facilitate servicing of the components thereon. In the preferred embodiment of the invention rollout tray 66 supports a check accepter validater generally indicated 68.

Although rollout trays 62 and 66 are shown as extending from the rear opening 18 of the second enclosure portion, it should be understood that in other embodiments of the invention such rollout trays may be configured with components so as to be extendable from a front opening or from both a front opening and a rear opening. It should further be mentioned that each of rollout trays 62 and 66 are independently movable. This enables the components on one tray to be extended for servicing while the other components remain retracted and out of the way of the service technician. After servicing the components on the extended tray such tray may be returned to the interior area of the machine and the tray above or below the prior tray extended to service the components thereon. This arrangement also greatly improves service access and reduces the floor space required for servicing in the same manner as with the trays arranged in a horizontal side-by-side arrangement.

Figure 7:
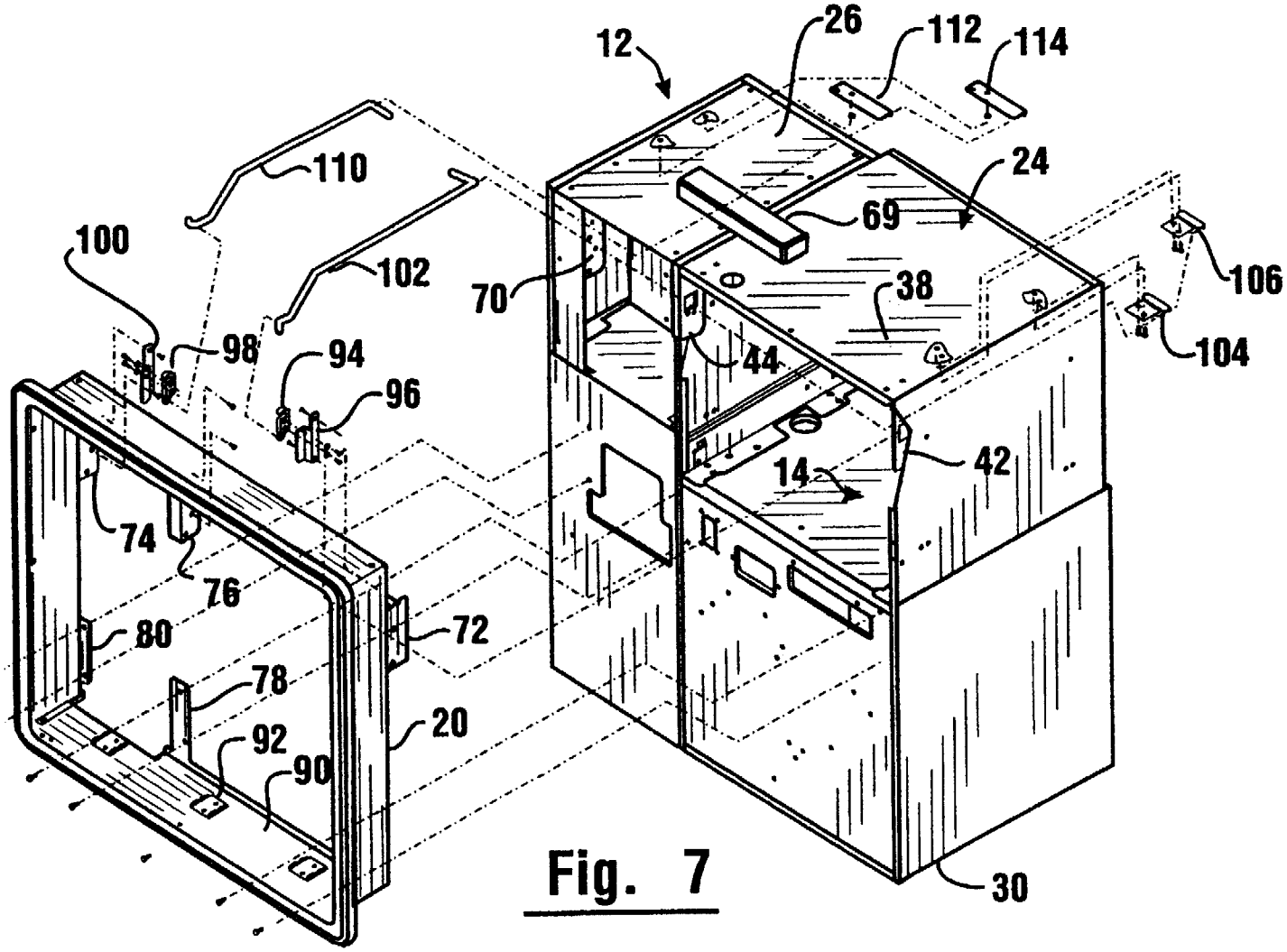
FIG. 7 is a front perspective view of the enclosure with the frame shown removed therefrom.

As shown in FIG. 7, first enclosure portion 24 and second enclosure portion 26 are held in adjacent relation by fasteners. A wiring enclosure 69 extends between the enclosure portions. Second enclosure portion 26 further includes a frame mounting area 70. Frame mounting area 70 is disposed in opposed relation with mounting area 42 of the first enclosure portion.

As shown in FIG. 7, frame 20 includes a first mounting bracket 72 and a second mounting bracket 74. First mounting bracket is engaged to mounting area 42 by conventional fasteners. Mounting bracket 74 is engaged to frame mounting area 70 by fasteners. Frame 20 further includes a central mounting bracket 76. Central mounting bracket 76 is engaged with mounting area 44 to further hold the frame in engaged relation with the rest of the enclosure. Frame 20 further includes horizontally extending tabs 78, 80 and 82 through which fasteners extend to engage the frame with the rest of the enclosure.

Figure 6:
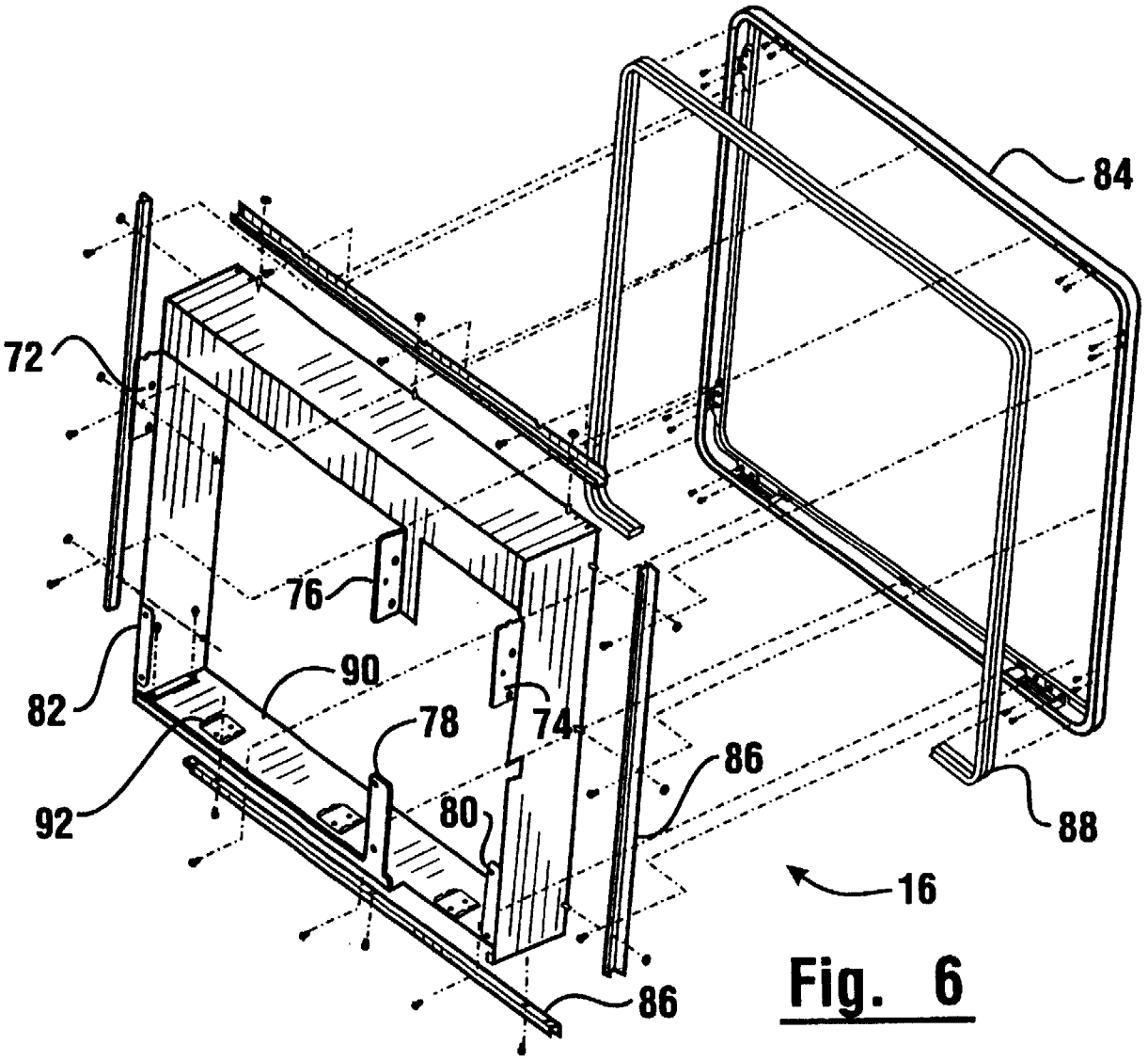
FIG. 6 is a rear isometric exploded view of a frame of the automated banking machine.

As shown in FIG. 6, frame 20 further includes a trim ring 84. Trim ring 84 is attached to the rest of the frame by channels 86 which extend outward on all sides of the frame. A gasket 88 comprised of resilient material extends between the channels and the trim ring.

Frame 16 includes a lower inside surface 90. Three latching brackets 92 are mounted to the frame on lower inside surface 90. Latching brackets 92 are part of a disengageable latch for holding the fascia in engagement with the frame as later discussed in detail.

A first lock 94 is connected to a first lock bracket 96 by fasteners. First lock bracket 96 is in turn attached to first mounting bracket 72. A second lock 98 is similarly attached to a second lock bracket 100 by fasteners. Second lock bracket 100 is fastened to second mounting bracket 74.

Figure 8:
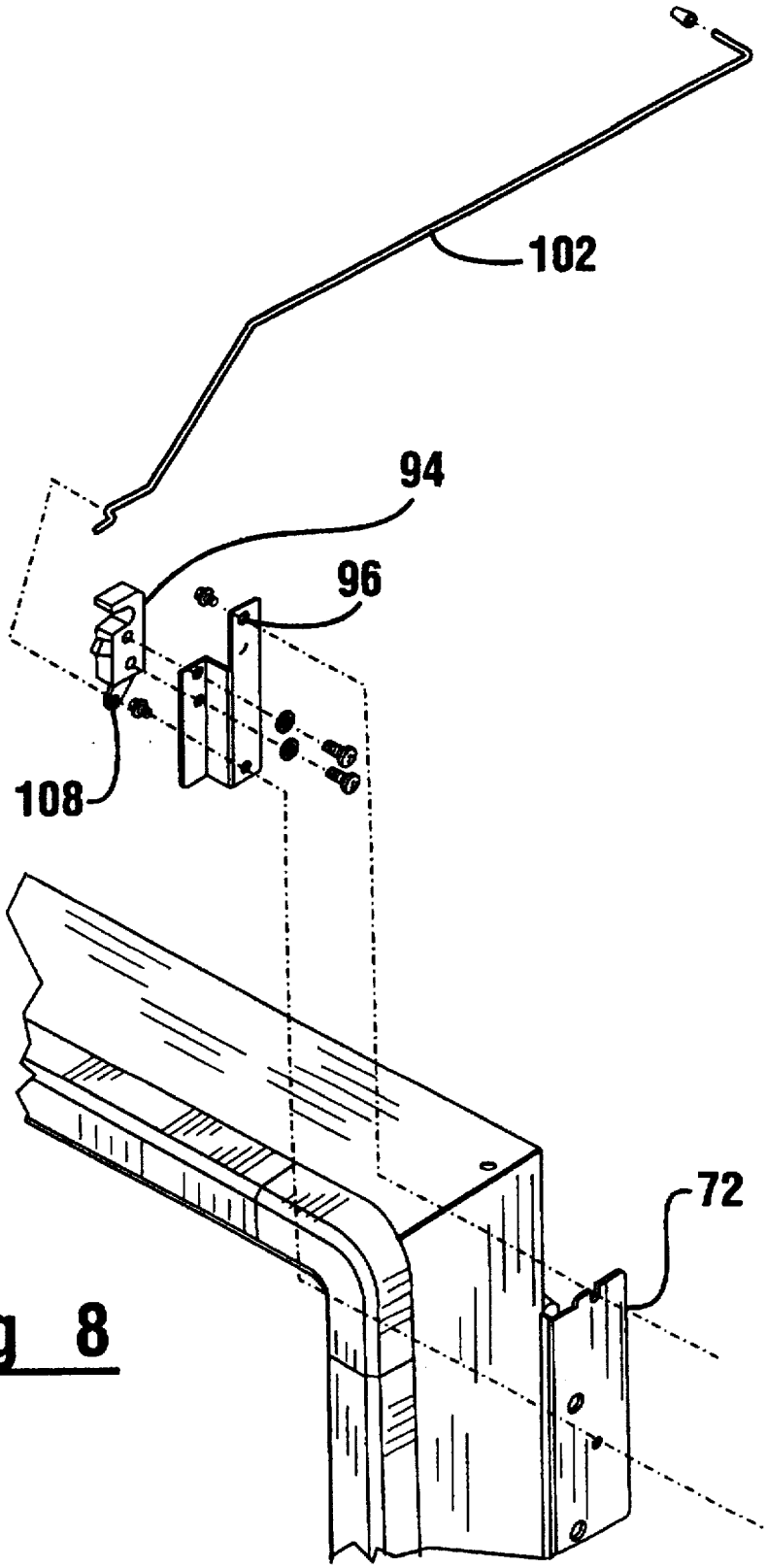
FIG. 8 is an isometric view of the frame shown in FIG. 7 and an enlarged view of a lock and release mechanism.

Lock 94 is connected to a release arm 102. Release arm 102 extends through openings in arm mounting brackets 104 and 106 which attach to the top wall 38 of first enclosure portion 24. Release arm 102 is movable in arm mounting brackets 104 and 106 so as to move a release lever 108 on lock 94 (see FIG. 8).

Lock 98 has a second release arm 110 similar to release arm 102. Release arm 110 is movably supported in arm mounting brackets 112 and 114 which are mounted to the top wall of second enclosure portion 26. Lock 98 includes a release lever similar to that of lock 94 which engages release arm 110.

The release arms 102 and 118 are connected to locks 94 and 98 respectively, and serve as release members which when actuated unlock the respective lock. The release arms are positioned in the interior area 14 of the ATM enclosure. As a result, in order to actuate the release arms of the locks it is necessary to unlock and open both service door 54 of the first enclosure portion 24, as well as upper service door 58 of the second enclosure portion.

Figure 13:
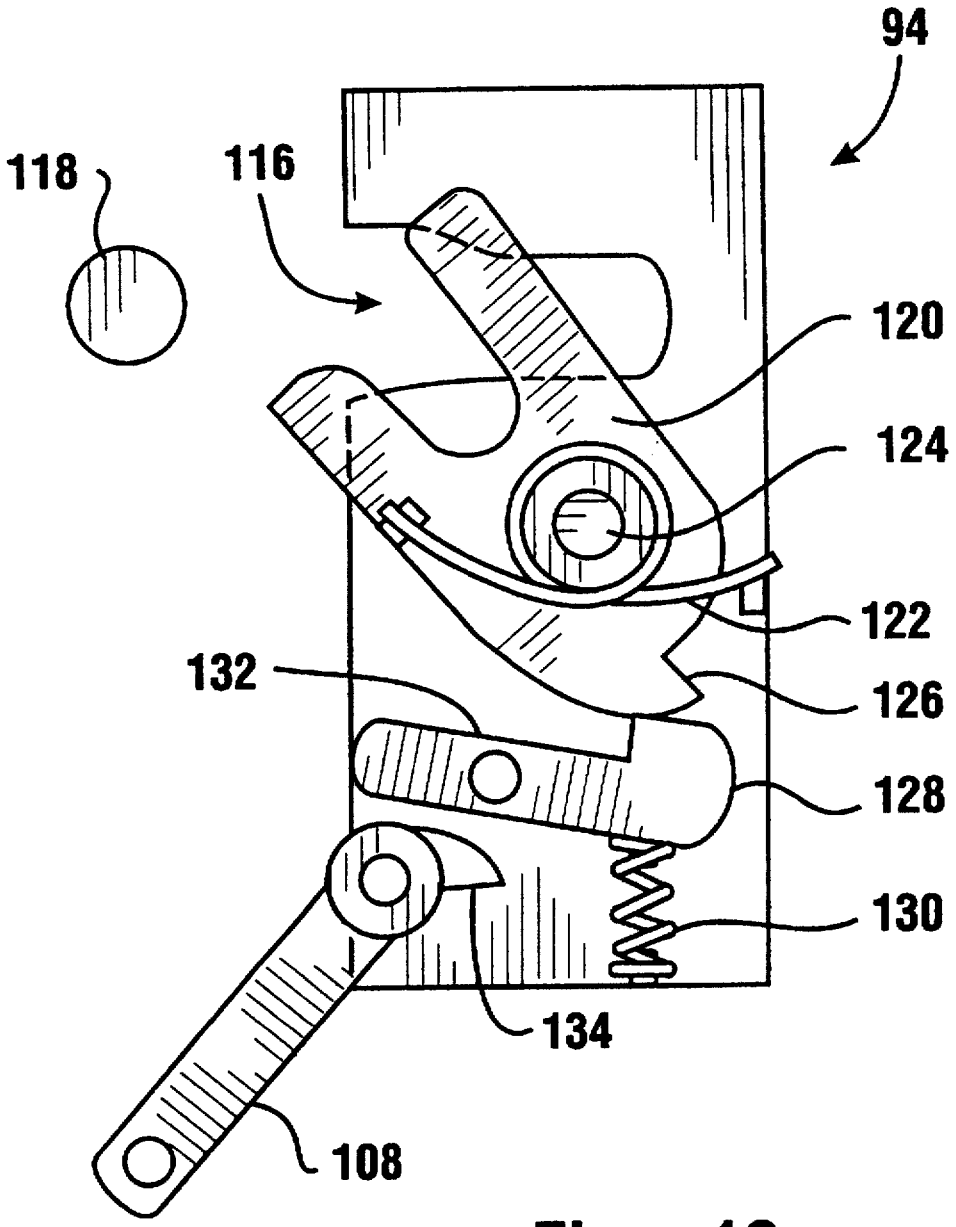
FIG. 13 is a cross sectional schematic view of the lock and locking pin.

As first and second locks 94 and 98 are similar in construction, only lock 94 will be described in detail. A schematic cross sectional view of lock 94 is shown in FIG. 13. The lock includes a slot generally indicated 116. Slot 116 is sized for releasibly accepting a locking pin which as later discussed, is in fixed connection with the fascia 22. The lock further includes a latching pawl 120. Latching pawl 120 is rotatably mounted about a pivot 124 and is biased in a counterclockwise direction as shown by a spring 122.

Latching pawl 120 includes a catch 126 thereon. Catch 126 is engageable with a lever 128 which is biased to engage the step by a spring 130. Lever 128 is rotatable about a pivot 132. Release lever 108 is biased in the clockwise direction as shown in FIG. 13 by a spring not shown. Release lever 108 includes a cam surface 134 thereon.

As can be seen with regard to FIG. 13, when the locking pin 118 is moved sufficiently into slot 116 the latching pawl 120 is rotated so that lever 128 engages catch 126. In this position the pin 118 is held by the latching pawl in the slot. Upon clockwise movement of release lever 108 as shown in FIG. 13, lever 128 is rotated in a counterclockwise direction as shown so as to enable latching pawl 120 to rotate in a counterclockwise direction. The rotation of the latching pawl moves pin 118 out of the slot under the biasing force of spring 122.

It should be understood that the lock shown in FIG. 13 is only exemplary. Other types of locks may be used in embodiments of the invention as part of the disengageable latch for holding the fascia in engagement with the enclosure. Further, in alternative embodiments the positions of the locking pins and locks may be reversed wherein the locks are supported on the fascia and the locking pins are supported on the frame or the enclosure.

Figure 5:
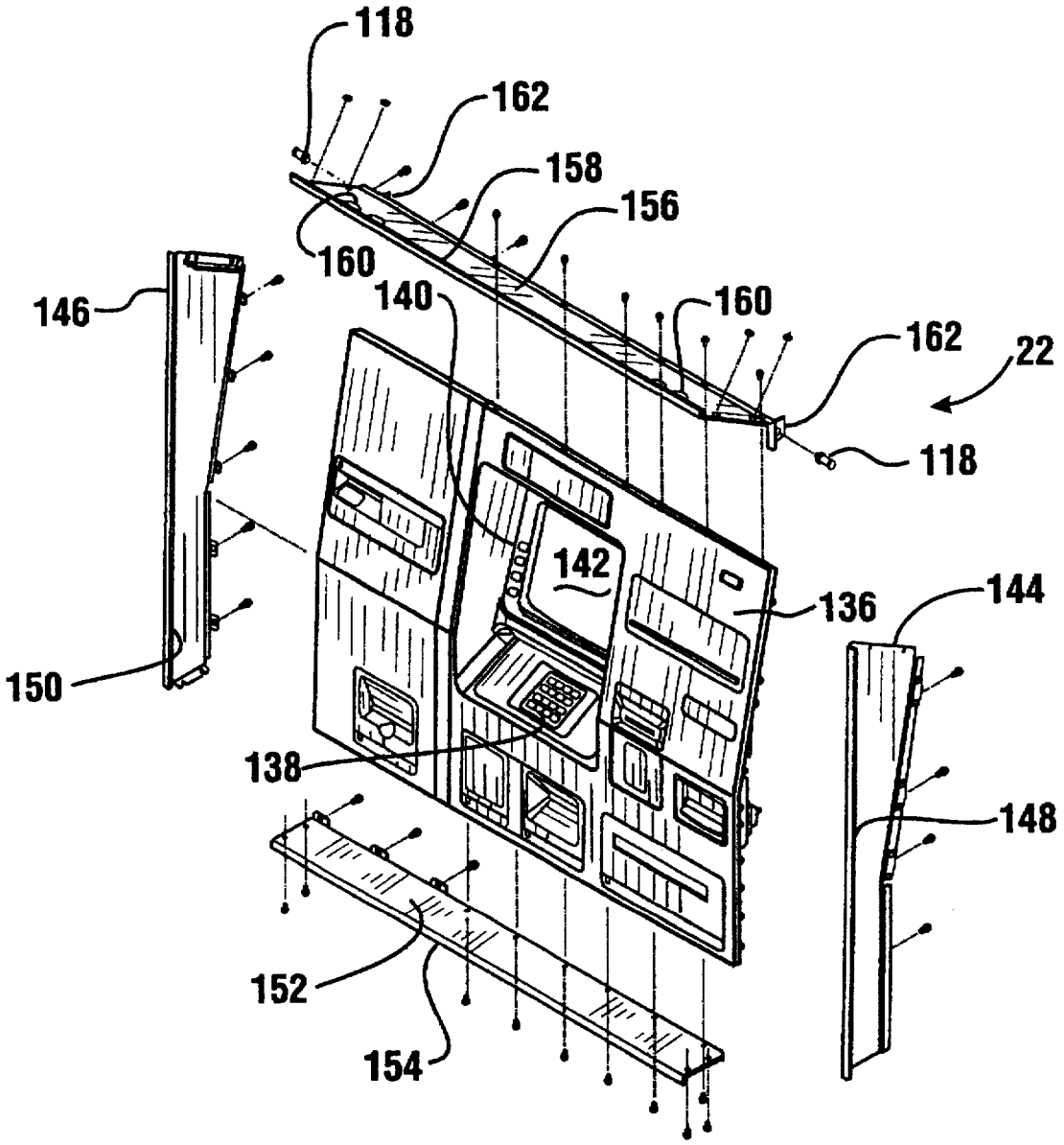
FIG. 5 is an isometric exploded view of a fascia of the automated banking machine shown in FIG. 1.

The construction of fascia 22 is shown in greater detail with regard to FIG. 5. Fascia 16 includes a customer interface panel 136. Customer interface panel 136 has supported thereon customer input devices such as a keyboard 138 and function buttons 140. Function buttons 140 are positioned adjacent to a screen opening 142 through which the screen of the CRT may be viewed by a customer when the fascia and CRT are in the operative positions. The customer interface panel 136 further includes a number of openings for passing items therethrough to other components of the machine. The openings are used to pass items such as credit and debit cards, deposits, cash, checks and passbooks. Each of the various openings in the customer interface panel 136 generally has a sensor or other indicators adjacent thereto for sensing the passage of items through the opening. As later discussed, these sensors are mounted in supported connection with the fascia as are the input devices.

As shown in FIG. 5, a pair of side panels 144 and 146 are attached to the sides of the customer interface panel 136. Side panel 144 has an outward extending lip 148 extending along the front thereof. Similarly, side panel 146 has an outward extending lip 150 extending outwardly therefrom.

A lower panel 152 is attached by fasteners to the bottom of the customer interface panel 136. Lower panel 152 extends between the side panels 144 and 146 and is attached thereto by fasteners as shown. Lower panel 142 further includes an outward extending lip 154 thereon.

A top panel 156 is attached to the top of the customer interface panel 136 by fasteners. Top panel 156 is also attached to the tops of the side panels 144 and 146. Top panel 156 further includes an outward extending lip 158 at the front thereof. Panel 156 further includes spaced recesses generally indicated 160 that extend in the exterior surface thereof. Recesses 160 do not extend through the top panel 156 but rather serve as fingerholds to facilitate manually engaging the panel. The lips of the four panels surrounding panel 136 form a generally continuous outward extending lip which extends about a periphery of the fascia.

Top panel 156 further includes a pair of spaced ears 162 at the sides thereof. Ears 162 extend inwardly in the interior area of the enclosure. A locking pin 118 is mounted on each of ears 162.

Figure 9:
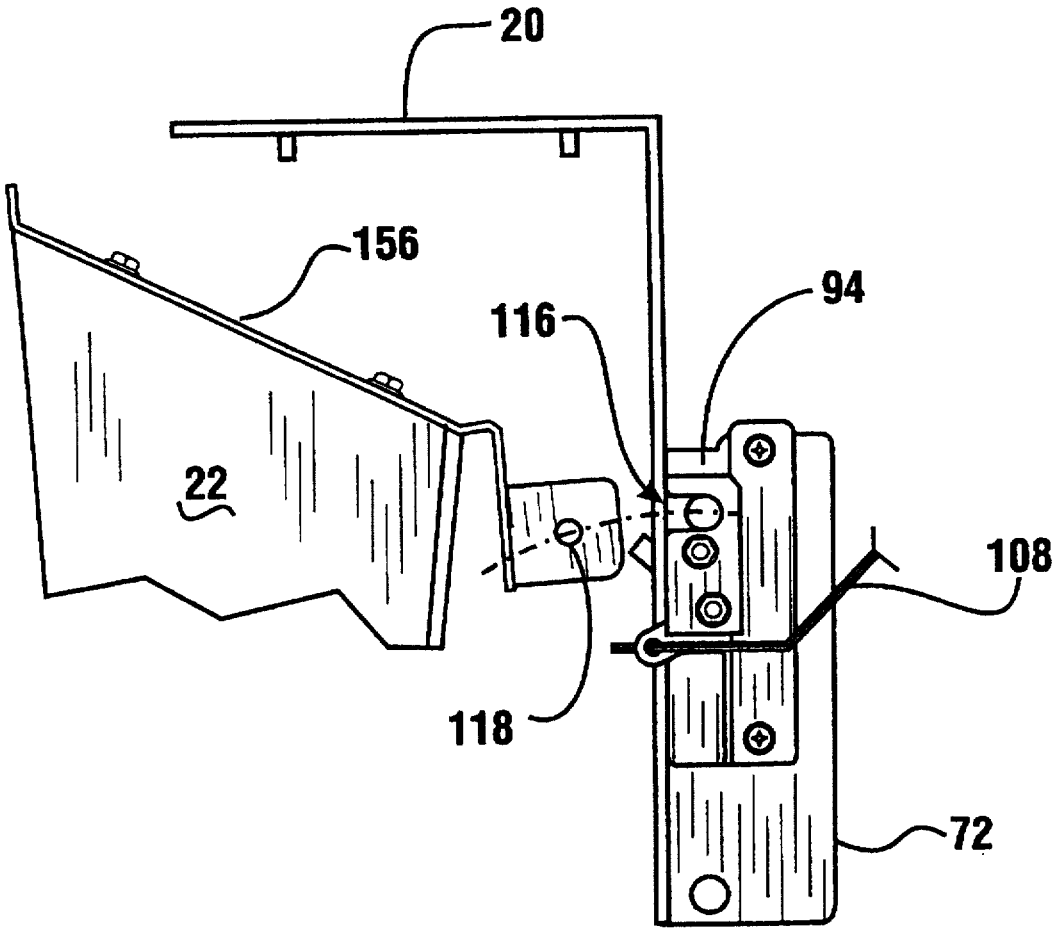
FIG. 9 is a side schematic view showing connection of a lock and a locking pin in connection with the fascia.

The locking pins 118 along with locks 94 and 96 previously discussed, form part of a disengageable latch for the fascia 22. As shown in FIG. 9, the ears 162 on top panel 156 extend inboard of the locks. The pins attached to the ears are aligned with the slots of the locks such as slot 118 of lock 94 shown. When the fascia 22 is in its fully extended position within the frame 20, locking pins 118 extend sufficiently into the slots so as to rotate the latching pawls. This holds both locking pins 118 in locked relation in the locks. The latching pins remain engaged with the locks until each of the release levers 108 and 110 are actuated so as to enable the top of the fascia to be moved to an outward position as shown in FIG. 9.

Figure 10:
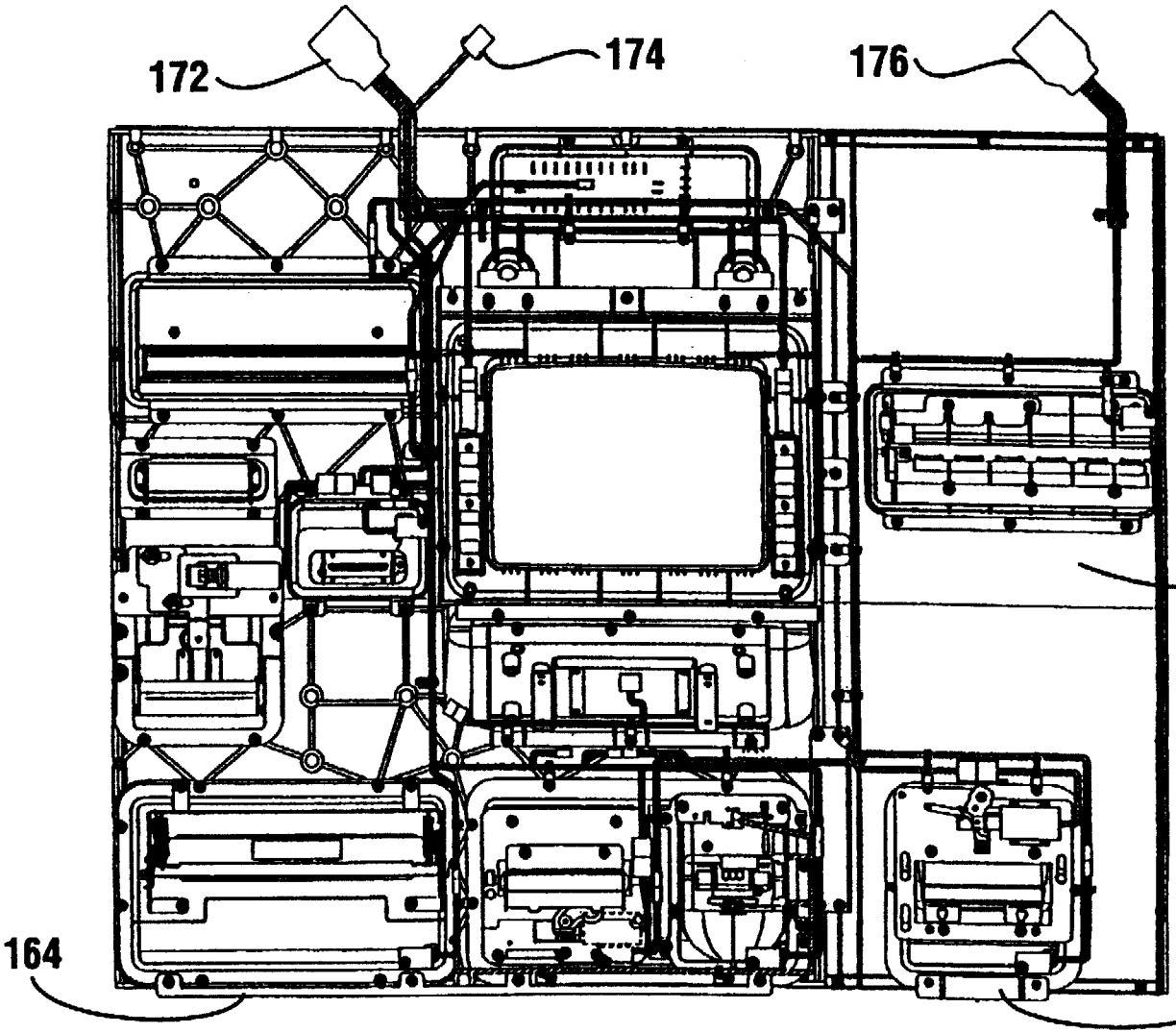
FIG. 10 is a rear plan view of the fascia.

The preferred embodiment of the disengageable latch of the present invention further includes a first projecting bracket 164 which is attached to a lower portion of the back of customer interface panel 136 as shown in FIG. 10. A second projecting bracket 166 is attached to the back of the customer interface panel in a similar manner.

Figure 12:
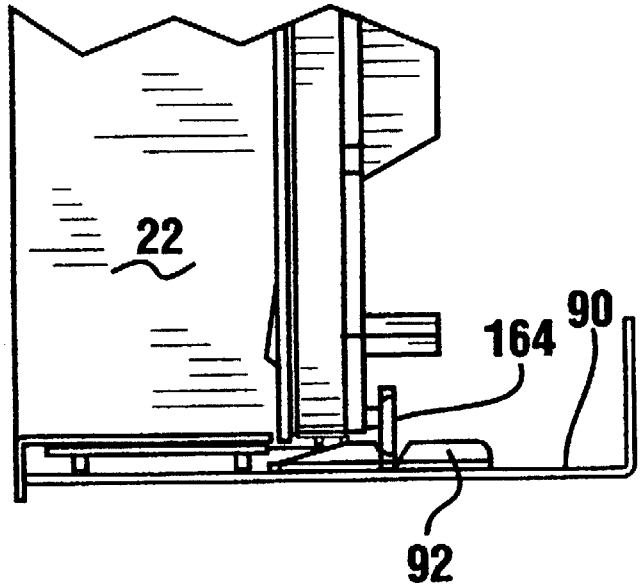
FIG. 12 is a side view similar to FIG. 11 showing the lower portion of the frame and fascia in engaged relation.
Figure 11:
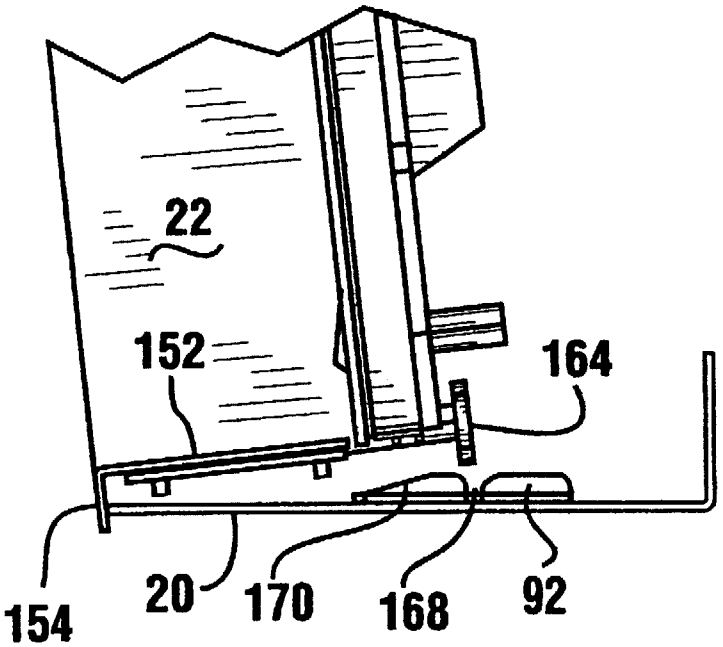
FIG. 11 is a side schematic view of the lower portion of the fascia and frame moving towards an engaged position.

As shown in FIGS. 11 and 12, first and second projecting brackets 164 and 166 are operative to hold fascia 22 positioned in the frame by engagement with latching brackets 92. Each of the latching brackets 92 include a recess 168. A ramp portion 170 extends outwardly of recess 168 towards the front of the frame 20.

Figure 14:
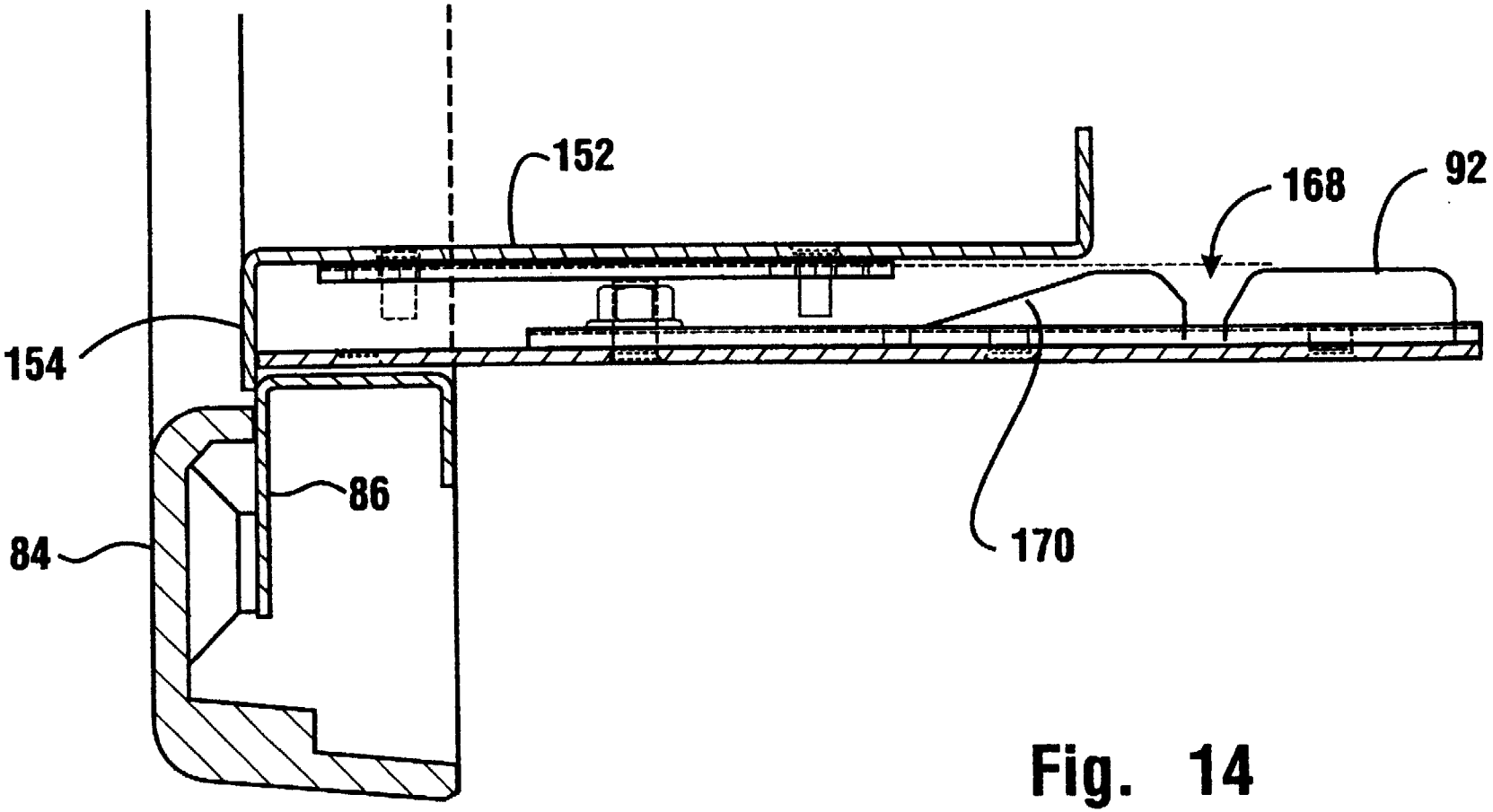
FIG. 14 is a side cross sectional view of the lower portion of the fascia and the frame.

As shown in FIGS. 11 and 12, the downwardly extending projections of first projecting bracket 164 and second projecting bracket 166 are movable into engagement with the recesses 168 of latching brackets 92. This is preferably accomplished by engaging the lip 154 of the lower panel 152 with the outer surface of the frame, channel and trim ring assembly (see FIG. 14). The fascia is then rotated into position such that the projections engage the recesses 168 in the latching brackets. As the projections engage the recesses the locking pins 118 rotate into engagement with the locks 94 and 98 as shown in FIG. 9. The ramps 170 being outwardly positioned of the recesses facilitate engagement of the projections in the recesses by avoiding snagging and by enabling the projecting brackets 164 and 166 to be slid up the ramps 170 of the latching brackets 92.

With the projecting brackets 164 and 166 engaged in the recesses 168 of the latching brackets and the locking pins 118 engaged in the locks 94 and 98, the fascia is held securely in position extending within frame 20. The fascia is held in this position until it is desired to remove it. To remove the fascia the service doors 54 and 58 must be unlocked and moved to an open condition sufficient to enable access to release arms 102 and 110. Moving the release arms rearwardly unlocks the locks and rotates the latching pawls thereof so as to push the locking pins 118 outward. The locking pins are biased outwardly by the springs that are in operative connection with the latching pawls. With the fascia moved outwardly generally to the position shown in FIG. 9, a service technician may engage his or her fingers in the recesses 160 of the top panel 156 so as to move the top of the panel outwardly. The technician rotates the fascia to disengage projecting brackets 164 and 166 from the recesses in latching brackets 92. This enables the fascia to be moved outwardly from the front opening 16. It should be understood that while in the preferred embodiment the projections and the projecting brackets are fixed relative to the fascia and the interengaging recesses which accept the projections are fixed relative to the enclosure, in other embodiments other arrangements may be used including the reverse of the arrangement of the preferred embodiment.

As shown in FIG. 10, the input devices, sensors and other electrical items that are mounted on the interior of the customer interface panel are connected through a wiring harness with releasible connectors 172, 174 and 176 thereon. The releasible connectors are enabled to be disengaged from mating connectors inside the machine so as to enable the . fascia to be removed from the machine entirely. This fully opens the front opening 16 of both enclosure portions 24 and 26 so as to provide service access and enable the rollout trays and serviceable components thereon to be extended out the front opening.

A further advantage associated with having a fully removable fascia is the ability to easily test and replace the input devices, sensors and other electrical devices mounted thereon. This is achieved because with the fascia removed ready access is available to the components and fasteners on the fascia panel. In addition, the input devices, sensors and other electrical components on the fascia panel may be readily tested. This is done either through testing or by connecting the releasible connectors 172, 174 or 176 to the mating connectors in the interior area 14 with jumper cables. This enables the service technician to operate the input devices, sensors and other electrical devices and observe the operation of the machine components in the interior area of the machine through the front opening or to test the functioning of such components with test equipment. This facilitates trouble shooting of the machine.

It should be understood that while in the embodiment of the invention shown herein the second enclosure portion 26 has been added to the first enclosure portion, other embodiments of the invention may be comprised of a frame corresponding in size to only the first enclosure portion. Such an enclosure would still provide the benefits of the present invention including a removable front fascia which provides access to the interior area of the enclosure through both a front opening or a rear opening.

Alternative embodiments of the invention may also include a second enclosure portion identical to the first enclosure portion which includes a second secure chest. Such an enclosure would provide a double wide machine and additional space for holding valuable items such as cash or deposits. Such a machine may be readily accommodated by adjusting the size of the frame and fascia portions to correspond to the width of the enclosure. Likewise, machine enclosures corresponding to various combinations of first and second enclosure portions may be made. This enables structuring an enclosure so as to meet the needs and requirements of the particular components that are to be housed in the machine and which require periodic servicing.

Thus, the new automated teller machine with improved service access of the present invention achieves the above-stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are for descriptive purposes and are intended to be broadly construed. Moreover, the descriptions and illustrations given herein are by way of examples and the invention is not limited to the exact details shown and described. Further, in the following claims any feature described as a means for performing a function shall be construed as encompassing any means capable of performing the function and not merely the means used in the foregoing described embodiment or mere equivalents.

Having described the features, discoveries and principles of the invention, the manner in which it is constructed and operated and the advantages and useful results attained, the new and useful structures, devices, elements, arrangements, parts, combinations, systems, equipment, operations and relationships are set forth in the appended claims.

We claim:

1. An automated banking machine comprising:

an enclosure having an interior area housing a plurality of banking machine components, the enclosure having a front opening and a rear opening, wherein the components are accessible through at least one of the openings;

a frame in operative connection with the enclosure wherein the frame bounds the front opening;

a service door in movable operative connection with the enclosure, wherein the service door is operable to selectively open and close the rear opening, the components in the enclosure being accessible when the rear opening is open; and a fascia, wherein the fascia is removably mounted relative to the enclosure, wherein the fascia is movable between a closing position, wherein the fascia extends in recessed relation relative to the frame and closes the front opening, and an open position wherein the fascia is disposed from the front opening.

2. The machine according to claim 1 and further comprising a disengageable latch, wherein said latch is operative in an engaged condition to hold said fascia in the closing position in said front opening.

3. The machine according to claim 2 wherein said disengageable latch includes a release member, and wherein the release member is housed in the interior area and is movable to disengage the latch, and wherein the release member extends adjacent to the rear opening and becomes accessible for movement immediately upon opening of the service door.

4. The machine according to claim 3 and further comprising a lock, wherein said lock is in operative connection with said service door, whereby said lock limits access to said interior area and said release member.

5. The machine according to claim 1 and further comprising a disengageable latch, wherein said latch has a release member accessible in said interior area and wherein said disengageable latch is operative in an engaged condition to hold said fascia in the closing position.

6. The machine according to claim 1 wherein said enclosure houses at least one rollout tray, wherein at least one of said components is supported on said rollout tray, and wherein said rollout tray is extendable from said interior area out one of either said front opening or said rear opening when said fascia is in the open position or said service door is open.

7. The machine according to claim 6 wherein the enclosure comprises two rollout trays in generally side-by-side relation, wherein at least one of the components is supported on each of the trays, and wherein the trays are independently movable to extend out of the interior area.

8. The machine according to claim 6 wherein said enclosure comprises a secure chest, and wherein said rollout tray is positioned above said secure chest.

9. The machine according to claim 1 wherein said enclosure includes a secure chest, and wherein said interior area is positioned above said secure chest.

10. An automated banking machine comprising:

an enclosure having an interior area housing a plurality of banking machine components, the enclosure having a front opening and a rear opening, wherein the components are accessible through at least one of the openings;

a service door in movable operative connection with the enclosure, wherein the service door is operable to selectively close the rear opening, a fascia, wherein the fascia is movably mounted relative to the enclosure, wherein the fascia is movable between a closing position wherein the fascia closes the front opening, and an open position wherein the fascia is disposed from the front opening;

a disengageable latch, wherein the latch is operative in an engaged condition to hold the fascia in the closing position in the front opening; and a spring, wherein the spring biases the fascia outward from the front opening, whereby the spring is operable to move the fascia outward upon disengagement of the latch.

11. An automated banking machine comprising:

an enclosure having an interior area housing a plurality of banking machine components, the enclosure having a front opening bounded by a frame and a rear opening, wherein the components are accessible through at least one of the openings;

a service door in movable operative connection with the enclosure, wherein the service door is operable to selectively close the rear opening;

a fascia, wherein the fascia is movably mounted relative to the enclosure, wherein the fascia is movable between a closing position wherein the fascia extends in the frame and closes the front opening, and an open position wherein the fascia is disposed from the front opening; and a disengageable latch, wherein the latch is operative in an engaged condition to hold the fascia in the closing position in the front opening, wherein the disengageable latch comprises an interengaging projection and recess, wherein one of either the projection or the recess is in operatively fixed connection with the fascia or the frame, and the other of the projection or the recess is in operatively fixed connection with the other of the fascia or the frame.

12. The machine according to claim 11 wherein said recess is in operatively fixed connection with said frame, and further comprising a ramp disposed between said front opening and said recess, whereby said projection is guidably directed to said recess by said ramp.

13. An automated banking machine comprising:

an enclosure having an interior area housing a plurality of banking machine components, the enclosure having a front opening and a rear opening, wherein the components are accessible through at least one of the openings;

a service door in movable operative connection with the enclosure, wherein the service door is operable to selectively close the rear opening;

a fascia, wherein the fascia is movably mounted relative to the enclosure, wherein the fascia is movable between a closing position wherein the fascia closes the front opening, and an open position wherein the fascia is disposed from the front opening; and a disengageable latch, wherein the latch is operative in an engaged condition to hold the fascia in the closing position in the front opening, wherein the disengageable latch comprises a latching pin in operatively fixed connection with the fascia, and a latching pawl in operatively fixed connection with the enclosure, and wherein the pawl engages the pin to hold the fascia in connection with the enclosure.

14. The machine according to claim 13 wherein said disengageable latch further comprises a projection in operatively fixed connection with said fascia and an interengaging recess in operatively fixed connection with said enclosure, wherein said projection is accepted in said recess to hold said fascia and said enclosure in engagement, and wherein said projection is positioned adjacent to a first side of said fascia and wherein said latching pin is disposed adjacent to a generally opposed side of said fascia.

15. An automated banking machine comprising:

an enclosure having an interior area housing a plurality of banking machine components, the enclosure having a front opening and a rear opening, wherein a surface generally extends about a periphery of said front opening, and wherein the components are accessible through at least one of the openings;

a service door in movable operative connection with the enclosure, wherein the service door is operable to selectively close the rear opening;

a fascia, wherein the fascia is movably mounted relative to the enclosure, wherein the fascia is movable between a closing position wherein the fascia closes the front opening, and an open position wherein the fascia is disposed from the front opening; and an outward extending lip in operative connection with the fascia wherein the lip extends generally outward about a fascia periphery, and wherein the lip abuttingly engages the surface when the fascia is in closing relation with the front opening.

16. An automated banking machine comprising:

a generally rectangular enclosure having a pair of spaced side walls and a top wall, said enclosure defining an interior area, and wherein said enclosure has a front opening and a rear opening generally defined by said walls;

a service door selectively movable on said machine wherein said service door selectively opens and closes said rear opening;

a fascia movably mounted on said machine wherein said fascia selectively opens and closes said front opening, wherein the fascia has an input device in generally operatively fixed connection with the fascia whereby the input device remains with the fascia when the fascia opens the front opening, and wherein a releasible electrical connector releasibly operatively connects the input device to a component located in the interior area of the enclosure; and a disengageable latch for selectively holding said fascia in closing relation with said front opening.

17. The machine according to claim 16 wherein said disengageable latch includes a release member, and wherein said release member is operative to enable movement of said fascia to open said front opening.

18. An automated banking machine comprising:

a generally rectangular enclosure having a pair of spaced side walls and a top wall, the enclosure defining an interior area and wherein the enclosure has a front opening and a rear opening generally defined by the walls and wherein the interior area is accessible through the front and the rear openings;

a service door selectively movable on the machine wherein the service door selectively opens and closes the rear opening;

a fascia movably mounted on the machine wherein the fascia selectively opens and closes the front opening, and wherein the fascia has an input device in operatively fixed connection therewith, whereby the input device remains with the fascia when the fascia is in the open condition; and a disengageable latch for selectively holding the fascia in closing relation with the front opening.

19. The machine according to claim 18 and further comprising a releasible electrical connector wherein said connector releasibly connects said input device from a component located in said interior area.

20. An automated banking machine comprising:

a generally rectangular first enclosure having a pair of spaced side walls and a top wall, the enclosure defining a first interior area, and wherein the first enclosure has a first front opening and a first rear opening generally defined by the walls;

a service door selectively movable on the machine wherein the service door selectively opens and closes the first rear opening;

a second enclosure in operatively engaged relation with the first enclosure, the second enclosure having a second interior area, and the second enclosure having a second front opening;

a generally rectangular frame spanning the first and second front openings;

a fascia movably mounted on the machine wherein the fascia selectively opens and closes the first and second front openings; and wherein the fascia extends in the frame when in closing relation with the first and second front openings, whereby the fascia closes the first and second front openings; and a disengageable latch selectively holding the fascia in closing relation with the first and second front openings.

21. The machine according to claim 20 wherein said disengageable latch comprises an interengaging projection and recess, wherein one of said projection or recess is in operatively fixed connection with said fascia or said frame, and wherein said other of said projection or recess is in operatively fixed relation with said other of said fascia or said frame.

22. The machine according to claim 20 wherein said disengageable latch includes a pair of locking pins disposed from one another and a pair of latching pawls, wherein each of said latching pawls releasibly engages one of said locking pins to hold said locking pins in engagement therewith, and wherein one pair of either said locking pins or said latching pawls is in operatively fixed connection with said fascia and wherein one each of said other pair of locking pins or latching pawls is in operatively fixed connection with said first enclosure and said second enclosure.

23. The machine according to claim 20 wherein said second enclosure has a second rear opening selectively closeable by a second service door, and wherein said disengageable latch comprises a first release member and a second release member, and wherein said first release member is accessible in said first interior area, and wherein said second release member is accessible in said second interior area.

24. The machine according to claim 23 wherein said first service door is in operative connection with a first lock and said second service door is in operative connection with a second lock, wherein said first and second service doors are enabled to be opened responsive to the unsecured condition of said first and second locks respectively.

25. The machine according to claim 20 wherein at least one of said first or second enclosures houses a rollout tray therein, and wherein said rollout tray has at least one serviceable component supported thereon, and wherein said rollout tray is extendable out of one of either said front or rear opening of said one enclosure when said front opening or said rear opening is in an open condition.

26. The machine according to claim 25 and further comprising a secure chest, and wherein said rollout trays are positioned above said secure chest.

27. An automatic banking machine comprising:

a first enclosure having an interior area housing a plurality of banking machine components, the first enclosure having a first front opening and a rear opening, wherein the components are accessible through at least one of the openings;

a service door in movable operative connection with the first enclosure, wherein the service door is operable to selectively close the rear opening;

a fascia, wherein the fascia is removably mounted relative to the first enclosure, wherein the fascia is movable between a closing position wherein the fascia closes the first front opening, and an open position wherein the fascia is disposed from the first front opening, a second enclosure in operatively engaged relation with the first enclosure, the second enclosure having a second interior area, the second enclosure having a second front opening, and further comprising a generally rectangular frame spanning the first and second front openings, and wherein the fascia extends in the frame when in closing relation with the first and second front openings, whereby the fascia closes the first and second front openings.

28. A method for enclosing and selectively accessing components of an automated banking machine for servicing, wherein said machine includes an enclosure having an interior area housing said components, and wherein said enclosure has a front opening and a rear opening, comprising the steps of:

opening said rear opening by moving a service door, whereby access is gained to said interior area;

releasing a disengageable latch in said interior area, wherein releasing said latch releases a fascia held in said front opening; and opening said front opening by moving said fascia outwardly relative to the interior area from a frame extending in surrounding relation relative to the fascia.

29. The method according to claim 28 and prior to the step of opening said rear opening, further comprising the step of unlocking a lock in operative connection with said enclosure and said service door.

30. The method according to claim 28 and further comprising the step of disengaging said front fascia from said enclosure.

31. The method according to claim 28 and further comprising the steps of closing said front opening by moving said front fascia therein, and latching said disengageable latch to hold said front fascia in fixed relation with said front opening.

32. The method according to claim 31 wherein said closing step comprises moving said fascia to extend in a rectangular frame, wherein said rectangular frame is in operatively supported relation with said enclosure.

33. The method according to claim 28 and wherein said machine comprises two rollout trays in generally side-by-side relation, wherein a first of said rollout trays is in supporting connection with a first serviceable component and wherein said second rollout tray is in supporting connection with a second serviceable component, and further comprising the step of moving said first rollout tray to extend out of one of said front or rear openings.

34. The method according to claim 33 wherein a first area extends adjacent the enclosure, wherein the first area is occupied by the second tray when the second tray is extended from the enclosure and wherein the first area is unoccupied by the second tray when the second tray is in the enclosure, and further comprising the step of servicing the first component on the first extendable tray from the first area.

35. The method according to claim 34 wherein a second area extends adjacent to the enclosure, wherein the second area is occupied by the first tray when the first tray is extended from the enclosure and wherein the second area is unoccupied by the first tray when the first tray is in the enclosure, and further comprising the steps moving the first tray into the enclosure and extending the second tray from the enclosure through the one opening, and servicing the second component on the second tray from the second area.

36. The method according to claim 28 and further comprising the step of servicing said components in said interior area by accessing said components through said front opening.

37. The method according to claim 28 and further comprising the step of servicing said components in said interior area by accessing said components through said rear opening.

38. The method according to claim 28 and further comprising the step of physically accessing the banking machine components through both the front opening and the rear opening.

39. A method for enclosing and selectively accessing components of an automated banking machine for servicing, wherein the machine includes an enclosure housing the components, wherein at least one component is supported on a roll-out tray, and wherein the enclosure has a front opening and a rear opening, comprising the steps of:

opening one of either the front or rear openings by moving a first service cover;

releasing a disengageable latch, wherein releasing the latch releases a second service cover held in closing relation of the other of the front or rear openings;

opening the other opening by moving the second service cover;

moving said roll-out tray to extend through one of either said front or rear openings and then moving said roll-out tray to extend through said other of said front or rear openings.

40. A method for enclosing and selectively accessing components of an automated banking machine for servicing, wherein the machine includes an enclosure having an interior area housing the components, and wherein the enclosure has a front opening and a rear opening, comprising the steps of:

opening the rear opening by moving a service door, whereby access is gained to the interior area;

releasing a disengageable latch in the interior area, wherein releasing the latch releases a fascia held in the front opening;

opening the front opening by moving the fascia; and disengaging the fascia from the enclosure, wherein the disengaging step comprises disconnecting a releasable connector in electrical connection with an input device mounted on the fascia.

41. A method for enclosing and selectively accessing components of an automated banking machine for servicing, wherein the machine includes an enclosure having an interior area housing the components, and wherein the enclosure has a front opening and a rear opening, comprising the steps of:

opening the rear opening by moving a service door, whereby access is gained to the interior area;

releasing a disengageable latch in the interior area, wherein releasing the latch releases a fascia held in the front opening;

opening the front opening by moving the fascia;

closing the front opening by moving the fascia; and latching the disengageable latch to hold the front fascia in fixed relation in the front opening, wherein the latching step comprises engaging a locking pin and a latching pawl.

42. The method according to claim 41 wherein said latching step further comprises engaging a projection in a recess.

43. The method according to claim 42 wherein said locking pin and latching pawl are engaged adjacent a first side of said fascia in said interior area of said machine, and said projection and recess are engaged at a generally opposed side of said fascia in said interior area.

44. A method for enclosing and selectively accessing components of an automated banking machine for servicing, wherein the machine includes an enclosure having an interior area housing the components, and wherein the enclosure has a front opening and a rear opening, comprising the steps of:

opening the rear opening by moving a service door, whereby access is gained to the interior area;

releasing a disengageable latch in the interior area, wherein releasing the latch releases a fascia held in the front opening; and opening the front opening by moving the fascia outwardly relative to the interior area from a frame surrounding the fascia.

45. A method for enclosing and selectively accessing components of an automated banking machine for servicing, wherein the machine includes an enclosure having an interior area housing the components, and wherein the enclosure has a front opening an a rear opening, comprising the steps of:

opening the rear opening by moving a service door, whereby access is gained to the interior area;

releasing a disengageable latch in the interior area, wherein releasing the latch releases a fascia held in the front opening;

opening the front opening by moving the fascia;

disengaging a releasable electrical connector electrically connecting an input device supported on the fascia with at least one component in the enclosure; and connecting a jumper cable to electrically reconnect the input device and the component after the fascia has been moved from the front opening.

46. A method for enclosing and selectively accessing components of an automated banking machine for servicing, wherein the machine includes an enclosure having an interior area housing the components, and wherein the enclosure has a front opening and a rear opening, comprising the steps of:

opening the rear opening by moving a service door, whereby access is gained to the interior area;

releasing a disengageable latch in the interior area, wherein releasing the latch releases a fascia held in the front opening;

opening the front opening by moving the fascia;

disengaging a releasable electrical connector electrically connecting at least one electrical device supported on the fascia with at least one component in the enclosure;

separating th fascia from the enclosure; and connecting a jumper cable between the separate fascia and the connector, wherein the electrical device and the component are electrically reconnected.

47. The method according to claim 46 and further comprising the step of actuating said electrical device on said separate fascia, whereby functioning of said component is observed or tested.

48. An automated banking machine comprising:

an enclosure housing a plurality of banking machine components, said enclosure having a front opening and a rear opening, wherein said components are accessible through at least one of said openings;

a frame in operative connection with said enclosure, wherein said frame bounds said front opening;

a service door in movable operative connection with said enclosure, wherein said service door is operative to selectively close said rear opening; and a fascia, wherein said fascia is removably positioned in recessed relation in said frame, wherein said fascia closes said front opening when positioned in said frame.

49. A method for enclosing and selectively accessing components of an automated banking machine for servicing, wherein the machine includes an enclosure having an interior area housing the components, and wherein the enclosure has a first opening and a second opening, and wherein the first opening is bounded by a frame, wherein a first cover is movably mounted in the frame, and wherein the first cover closes the first opening when positioned in the frame, and wherein the machine further includes a second cover movably mounted relative to the enclosure, wherein the second cover closes the second opening when the second cover is positioned adjacent to the second opening, comprising the steps of:

opening one of either the first or second openings by moving one of either the first cover relative to the frame or the second cover relative to the enclosure, respectively, wherein access is enabled to be gained to the interior area through the one opening;

releasing a disengageable latch in the interior area, wherein releasing the disengageable latch releases the other of the first cover or the second cover;

moving the other of the first cover or the second cover, wherein access is enabled to be gained to the interior area through the other opening.

* * * * *